US007905443B2

(12) United States Patent
Papania

(10) Patent No.: US 7,905,443 B2
(45) Date of Patent: Mar. 15, 2011

(54) ADJUSTABLE VERTICAL ACCUMULATOR FOR SLITTING OPERATION

(76) Inventor: James F. Papania, Marlton, NJ (US)

( * ) Notice: Subject to any disclaimer, the term of this patent is extended or adjusted under 35 U.S.C. 154(b) by 215 days.

(21) Appl. No.: 11/977,929

(22) Filed: Oct. 26, 2007

(65) Prior Publication Data

US 2009/0108120 A1 Apr. 30, 2009

(51) Int. Cl.
*B65H 35/02* (2006.01)

(52) U.S. Cl. ..... 242/525.6; 226/118.2

(58) Field of Classification Search ..... 242/552, 242/417, 554.2, 530.1, 417.1–417.3, 410, 242/416, 520, 530, 550, 551, 554, 525.6, 242/538, 548.2, 615.1, 615.2; 72/66; 226/118.2, 226/118.3; 83/27, 84, 425, 425.3, 937, 949, 83/425.2

See application file for complete search history.

(56) References Cited

U.S. PATENT DOCUMENTS

| | | | | | |
|---|---|---|---|---|---|
| 2,165,917 | A | | 7/1939 | Black | |
| 2,623,590 | A | | 12/1952 | Johnson et al. | |
| 2,867,824 | A | | 1/1959 | O'Connor | |
| 3,406,924 | A | | 10/1968 | Bruns et al. | |
| 3,414,208 | A | * | 12/1968 | Butler, Jr. et al. | 242/421.6 |
| 3,685,711 | A | * | 8/1972 | Gay | 226/191 |
| 3,771,738 | A | * | 11/1973 | Abbey | 242/419.5 |
| 3,883,088 | A | | 5/1975 | Cannon et al. | |
| 3,978,703 | A | | 9/1976 | Primich et al. | |
| 4,030,679 | A | * | 6/1977 | Pelletier | 242/559.1 |
| 4,093,140 | A | * | 6/1978 | Matsunaga | 242/530.1 |
| 4,158,301 | A | | 6/1979 | Smith | |
| 4,173,313 | A | * | 11/1979 | Rogers | 242/525.4 |
| 4,201,352 | A | * | 5/1980 | Madachy | 242/419.4 |
| 4,298,633 | A | * | 11/1981 | Bradlee | 427/172 |
| 4,347,723 | A | * | 9/1982 | Bradlee | 72/130 |
| 4,447,016 | A | | 5/1984 | Enberg et al. | |
| 4,508,282 | A | | 4/1985 | Eiting | |
| 4,655,067 | A | | 4/1987 | Frost et al. | |
| 5,190,234 | A | | 3/1993 | Ezekiel | |
| 6,375,452 | B1 | * | 4/2002 | Nissel | 425/377 |
| 2006/0175457 | A1 | * | 8/2006 | Benvenuti et al. | 242/552 |

FOREIGN PATENT DOCUMENTS

| | | | |
|---|---|---|---|
| EP | 1 209 116 | | 5/2002 |
| EP | 1209116 | * | 5/2002 |
| WO | WO 03/022476 | * | 3/2003 |

* cited by examiner

*Primary Examiner* — Michael R Mansen
*Assistant Examiner* — Juan J Campos
(74) *Attorney, Agent, or Firm* — Norman E. Lehrer

(57) ABSTRACT

A vertical accumulator for use in a sheet metal unwinding, slitting and rewinding operation accumulates the slack created in the plurality of strips cut from an initial wide coil so that the proper tension can be maintained on the individual strips being rewound. The accumulator includes an elongated mandrel mounted for rotation about a horizontal axis parallel to the axis of the original sheet metal coil and is arranged such that all of the plurality of cut strips pass over the top of the mandrel. The mandrel is located above the height of the coil and above the height of the slitter and the rewound individual strips. A plurality of disks mounted on the mandrel separate the cut strips from each other. Upwardly extending threaded rotatable rods located on either side of the sheet metal strips carry holders that releasably support the mandrel. Rotation of the rods causes the holders to move up or down to thereby adjust the height of the mandrel.

1 Claim, 2 Drawing Sheets

44
58
62
60
54
64
78
32
56
34
76
46
68
72
70
36
50
74
66
48
52
40
38
42

ADJUSTABLE VERTICAL ACCUMULATOR FOR SLITTING OPERATION

BACKGROUND OF THE INVENTION

The present invention is directed toward apparatus for handling coils of sheet metal strip which includes apparatus for unwinding a coil of single metal strip for slitting to form a plurality of separate strips of predetermined width for rewinding the strips into individual coils and, more particularly, toward a vertical accumulator that maintains continuous tension in each strip during the rewinding operation.

In the continuous production of rolling of metal strip, it is difficult to prevent the forming rolls of a rolling mill from bowing by a slight amount. This is particularly true with wider strips which is caused, in part by the weight of the forming rolls, but primarily by the enormous radial loading on the rolls as they progressively compress the metal strip to reduce its thickness. As a result, the metal strip which is formed usually varies in cross-sectional thickness with the center portion of the strip being a few thousandths of an inch thicker than the edge portions. Furthermore, as the strips increase in width, usually the differential in thickness across each strip also increases. Thus when the single strip is coiled, the center portion of the single strip has a tendency to increase in diameter at a faster rate than the edge portions which results in producing greater tension in the center portion of the strip within the coil.

When the original single coiled strip is subsequently run through a slitting operation to form a plurality of separate metal strips, it has been found that the stresses within the original strip are relieved, and in addition, the strips formed from the center portion of the single strip will have a slightly greater thickness than those strips formed from the edge portion. Thus when each of these separate strips is rewound on a common mandrel into separate coils, the tension in the strips forming the center coils of the mandrel is substantially greater than the tension in the strips forming the outer or end coils.

As is well known in the art, is desirable to maintain sufficient tension in each of the strips forming the separate coils during the rewinding operation so that the coils are not loosely formed and will not collapse or telescope after they are removed from the rewinding mandrel. Thus a common procedure is to provide a frictional resistance or drag on each of the separate strips between the slitting and rewinding operations. This drag develops a progressively increasing slack in the strips formed from the edge portions of the original single strip. To accommodate the slack, it is common to form a large deep pit in line between the slitting and rewind operation in which to suspended loops of the strips as the slack progressively increases. The pit essentially acts as an accumulator for the suspended loops between the slitting and rewinding operations.

In view of the trend toward larger coil diameters for obtaining more efficient handling of the strips and more efficient use of the machines which subsequently receive the metal strips, it has been found necessary to construct deeper and deeper pits. Pits may be as deep as twenty or thirty feet or more. Since the coils being unwound, slit and rewound and the equipment for performing these operations are extremely heavy, the entire operation is normally performed on the ground floor of a facility and on a solid concrete slab. Thus, when a pit is needed, it must be dug down through the concrete and into the earth below. The pit itself must then be finished with a concrete floor and walls and the like to prevent ground water or the like from seeping in. Depending on the terrain, it may or may not be possible to dig and properly finish the necessary pit. But even when it can be done, it is obviously an expensive process. Furthermore, once the pit is formed, its depth cannot be changed without going through additional substantial expense.

Therefore, a need exists for a less expensive accumulator that does not require the construction of a large pit between the slitting and rewinding operations and which can be used in substantially any facility.

SUMMARY OF THE INVENTION

The present invention is designed to overcome the deficiencies of the prior art discussed above. It is an object of the present invention to provide an accumulator in a slitting and rewinding operation that eliminates the need for a pit yet maintains proper tension on each of the individual slit coils.

It is another object of the present invention to provide an accumulator in a slitting and rewinding operation that can be used in almost every facility without the need for major renovations to the facility.

It is a still further object of the present invention to provide an accumulator in a slitting and rewinding operation which allows for the amount of accumulation to be adjusted.

In accordance with the illustrative embodiments demonstrating features and advantages of the present invention, there is provided a vertical accumulator for use in a sheet metal unwinding, slitting and rewinding operation. The accumulator accumulates the slack created in the plurality of strips cut from an initial wide coil so that the proper tension can be maintained on the individual strips being rewound. The accumulator includes an elongated mandrel that is mounted for rotation about a horizontal axis parallel to the axis of the original sheet metal coil and is arranged such that all of the plurality of cut strips pass over the top of the mandrel. The mandrel is located above the height of the coil and above the height of the slitter and the rewound individual strips. A plurality of disks mounted on the mandrel separate the cut strips from each other. Upwardly extending threaded rotatable rods located on either side of the sheet metal strips carry holders that releasably support the mandrel. Rotation of the rods causes the holders to move up or down to thereby adjust the height of the mandrel.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there are shown in the accompanying drawings, one form that is presently preferred; it being understood that the invention is not intended to be limited to the precise arrangements and instrumentalities shown.

DETAILED DESCRIPTION OF THE PREFERRED EMBODIMENTS

Figure 1:
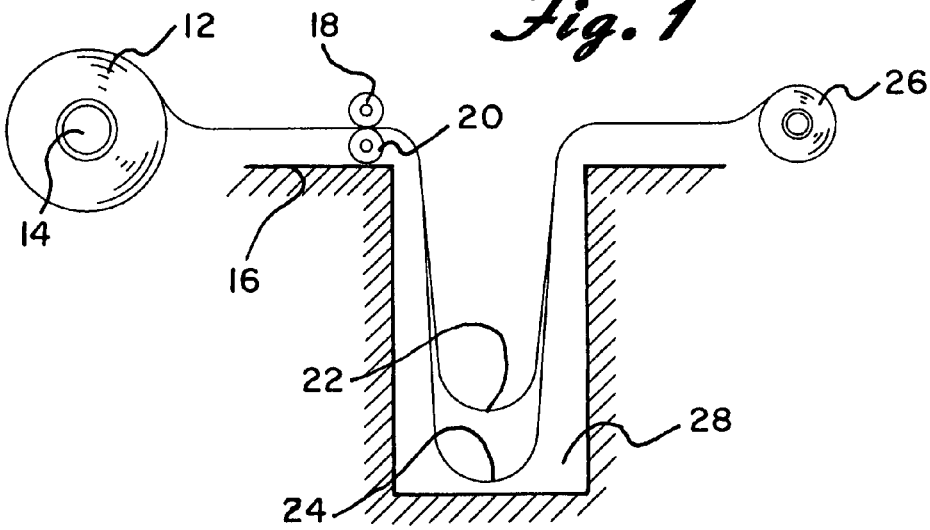
FIG. 1 is a diagrammatic representational view of a prior art system over which the present invention is an improvement.

Referring now to the drawings in detail wherein like reference numerals have been used throughout the various figures to designate like elements, there is shown diagrammatically in FIG. 1 a prior art system upon which the present invention is based. As is well known in the art, a sheet metal unwinding, slitting and rewinding operation starts with a wide coil of sheet metal 12 wound about a horizontal axis 14 which is mounted on the floor 16 for rotation about the axis 14. A pair of slitting rollers 18 and 20 slit the sheet metal 12 into a plurality of strips such as shown at 22 and 24. The slit strips 22 and 24 are then rewound at a rewind station where the individual strips are individually rewound into a plurality of smaller coils 26. Located between the slitter rollers 18 and 20 and the rewinding station is an accumulator in the form of a pit 28 dug downwardly beneath the floor 16. All of the foregoing is well known in the art. Accordingly, only a brief description of the same is believed to be necessary.

Figure 2:
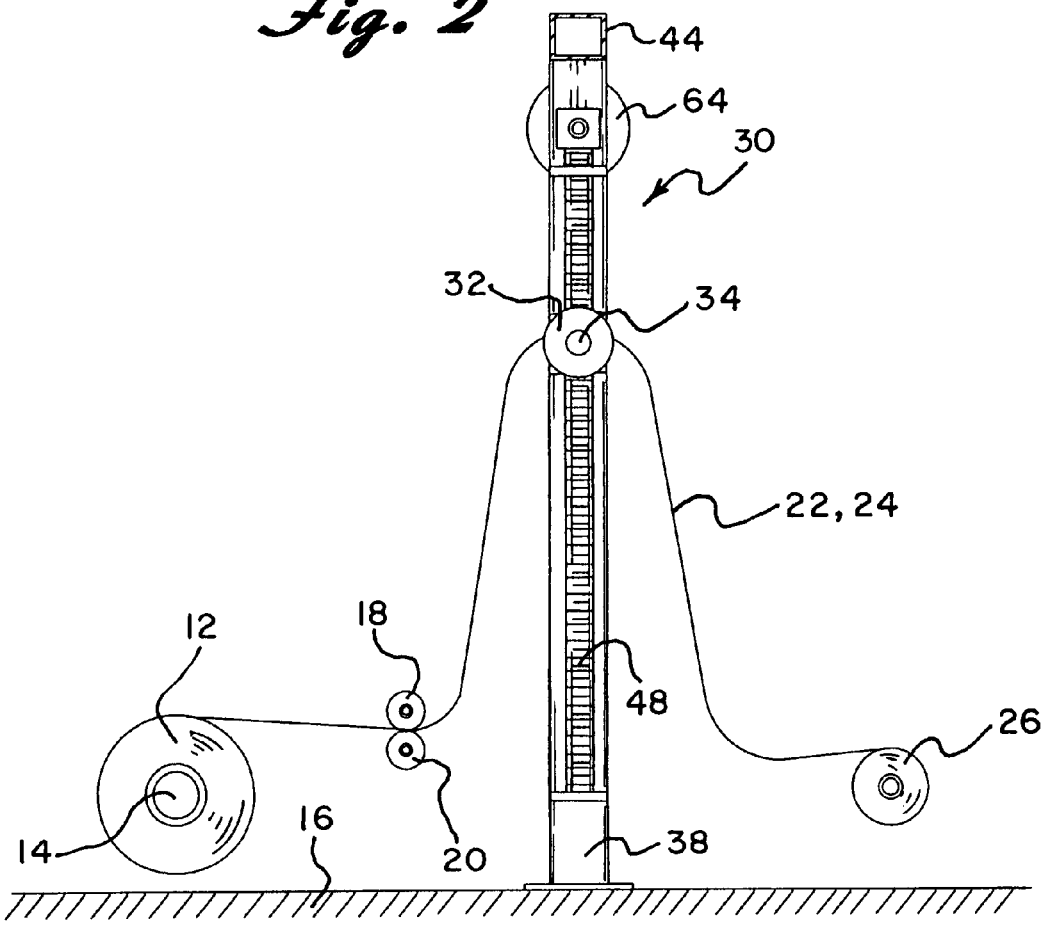
PRIOR ART Fig. 2
FIG. 2 is a diagrammatic representational view similar to FIG. 1 but showing the improvement of the present invention.

The improved system of the present invention is shown diagrammatically in FIG. 2. As with the prior art system, the improvement also starts with a wide coil of sheet metal 12 that is cut into strips by a pair of slitting rollers 18 and 20 and which is then rewound into a plurality of smaller coils 26. In lieu of the pit accumulator, however, the invention utilizes a vertical accumulator 30 that is also located between the slitting rollers 18 and 20 and the rewinding station.

As shown in FIG. 2, the accumulator 30 is comprised of a mandrel 32 that is mounted for rotation about a horizontal axis 34 parallel to the axis 14 of the coil 12. The mandrel 32 is arranged such that all of the plurality of slit strips travel upwardly and pass over the top of the mandrel. As is also best seen from FIG. 2, the mandrel 32 is located above the height of the coil 12 and is also above the slitters 18 and 20 and above the rewound individual smaller coils 26. However, and as will become apparent hereinafter, the mandrel is capable of moving upwardly and downwardly as desired.

Figure 3:
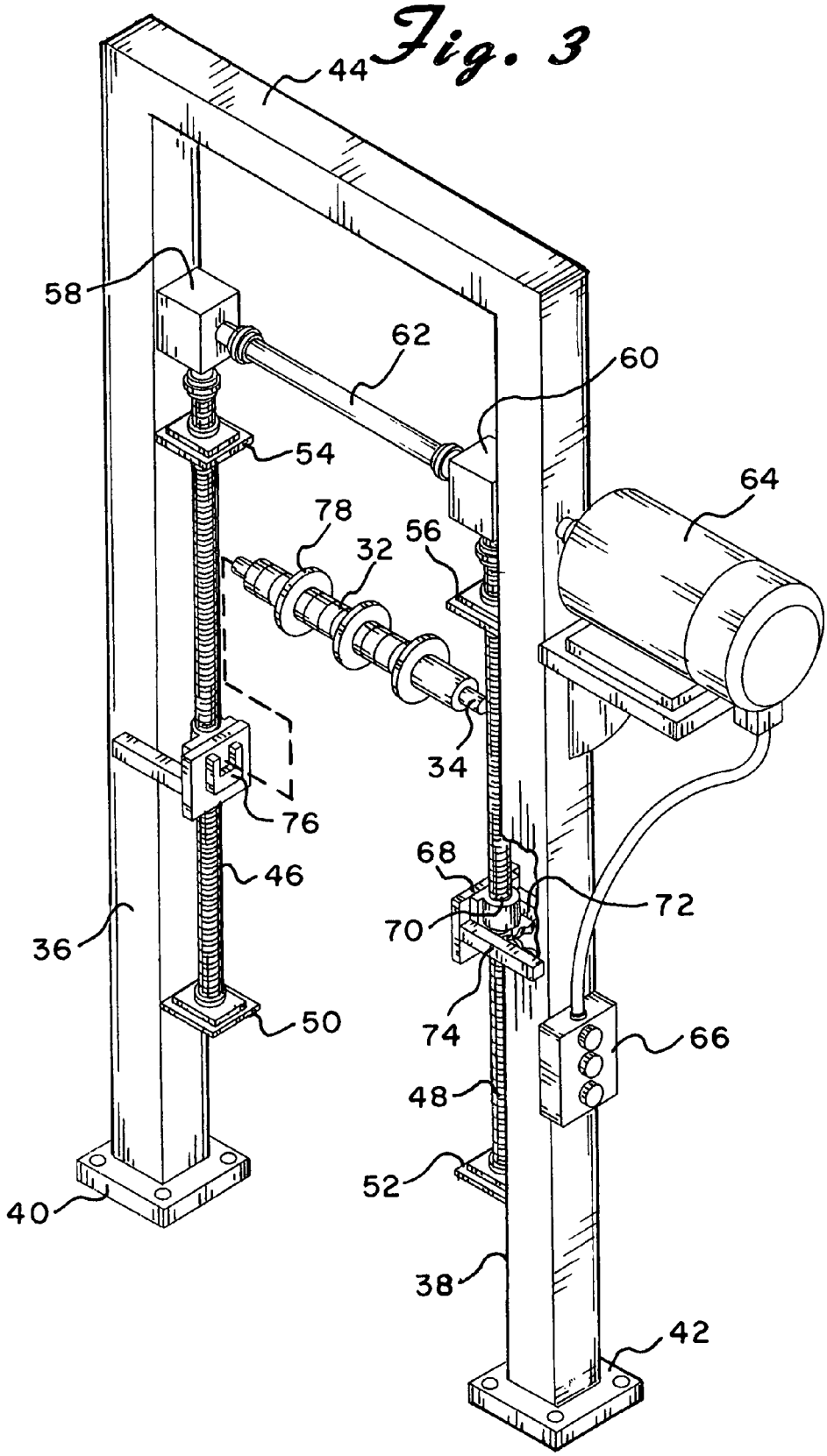
FIG. 3 is a diagrammatic representation, shown partially exploded, of the adjustable vertical accumulator of the invention.

The details of the accumulator 30 of the present invention are shown diagrammatically most clearly in FIG. 3. The mandrel 32 is supported by first and second vertically extending supports 36 and 38. These supports are mounted on either side of the sheet material so that the mandrel is properly arranged and are secured to the floor 16 at the feet 40 and 42 thereof, respectively. A horizontally extending beam 44 extends between the tops of the supports 36 and 38 to stabilize them and keep them in proper position.

Mounted to each of the supports 36 and 38 are upwardly extending rods 46 and 48. The rods 46 and 48 include an external thread thereon and are mounted for rotation about their own axes. This is accomplished utilizing flange bearings 50 and 52 at the bottoms and similar bearings 54 and 56 adjacent the tops thereof. The extreme top ends of the threaded rods 46 and 48 are connected to gearboxes 58 and 60 which are interconnected by a rotating rod 62.

Adjacent the upper end of the support 38 is an electric motor 64. The motor is controlled by switches 66 also carried by the support 38. Through gearbox 60, rod 62 and gearbox 58, the electric motor 64 is capable of rotating the threaded rods 46 and 48 around their own axes in either direction.

A mandrel holder, such as shown at 68, includes an internally threaded bore 70 extending vertically therethrough and is adapted to fit around either of the threaded rods 46 or 48. While only one holder 68 is shown in the drawing, it should be readily apparent that two are utilized. One is carried by the rod 46 while the other is carried by the rod 48. A pair of pins 72 and 74 extend rearwardly from the holder 68 and are adapted to be located on either side of the vertical supports 36 or 38. As a result, when the threaded rod 46 or 48 is rotated, the holder 68 is prevented from rotation by an interference fit between the pins 72 and 74 and the support 36 or 38 and it must, therefore, move upwardly or downwardly on the rotating threaded rod. Moving upwardly or downwardly will, of course, depend on the direction of rotation of the threaded rods 46 or 48.

On the front face of each of the holders 68 is a substantially U-shaped cup member 76. As shown at the bottom of FIG. 3, the cup member 76 has two sides and a bottom but is open at the top thereof. The space in between is adapted to support the ends of the axle 34 of the mandrel 32. Thus, as the holders 68 move up and down on the threaded rods 46 and 48, the mandrel 32 is likewise moved upwardly or downwardly. As is also shown in FIG. 3, the mandrel 32 can be provided with a plurality of disks 78 for separating the plurality of strips of sheet metal from each other after they have been cut.

Because the mandrel 32 can easily be placed into or removed from the holders 68, it need not be in place on the accumulator 30 when the unwinding, slitting and rewinding operation begins. If, however, it becomes necessary to begin accumulating excess slack, the mandrel can be easily inserted into place and can be moved up or down, as needed. Similarly, it can be removed whenever required.

The present invention may be embodied in other specific forms without departing from the spirit or essential attributes thereof and accordingly, reference should be made to the appended claims rather than to the foregoing specification as indicating the scope of the invention.

I claim:

1. In a sheet metal unwinding, slitting and rewinding operation including a wide coil of sheet metal mounted on a horizontal axis for being unwound, a slitter for slitting said wide coil into a plurality of strips, a rewinding station wherein said strips are individually rewound into a plurality of smaller coils and an accumulator located between said slitter and said rewinding station, wherein the improvement comprises:

said accumulator including an elongated mandrel mounted for rotation about a horizontal axis parallel to the axis of said coil of sheet metal and being arranged such that all of said plurality of strips pass over the top of said mandrel, said mandrel being located above the height of said wide coil of sheet metal, above said slitter and above said rewound individual strips;

a plurality of disks mounted on said mandrel for separating said plurality of strips from each other;

said mandrel including a first and a second end and wherein said accumulator includes first and second vertically extending supports for supporting said first and second ends of said mandrel, respectively;

first and second holders mounted on said first and second supports for releasably holding the first and second ends of said mandrel, each of said holders including a substantially U-shaped cup means for holding the sides and bottom of said ends of said mandrel, each of said holders being open at the top thereof so that the mandrel can be inserted or removed from the open top;

each of said supports including a vertically extending rod having an external thread formed thereon and including means for rotating each of said rods for adjusting the height of said mandrel;

each of said holders including a threaded bore and wherein its respective rod is threaded through said bore so that rotation of said rod causes said holder to move upwardly or downwardly, and means for preventing rotation of said holders.

* * * * *